US005405135A

United States Patent [19]

Embro

[11] Patent Number: 5,405,135

[45] Date of Patent: Apr. 11, 1995

[54] BLOCK PUZZLE

[76] Inventor: William J. Embro, 6320 SW. 13th St., Gainesville, Fla. 32608

[21] Appl. No.: 132,698

[22] Filed: Oct. 6, 1993

[51] Int. Cl.[6] ..... A63F 9/12

[52] U.S. Cl. ..... 273/160; 273/157 R; 434/159; 434/171

[58] Field of Search ..... 273/157 R, 157 A, 160; 434/159, 171

[56] References Cited

U.S. PATENT DOCUMENTS 3,235,975 2/1966 Pierson ..... 434/189
4,037,846 7/1977 Zeeman ..... 273/157 R
4,198,053 4/1980 Rao ..... 273/160
4,699,602 10/1987 Giorgi ..... 273/157 R X
4,784,392 11/1988 Johnson et al. ..... 273/160

*Primary Examiner*—William H. Grieb
*Attorney, Agent, or Firm*—McCormick, Paulding & Huber

[57] ABSTRACT

A cubic block puzzle assembled from a plurality of readily separable interfitting puzzle pieces shaped like various letters of the alphabet. The puzzle pieces may also be assembled in a multiplicity of other ways to produce fanciful representations of familiar objects, birds, animals, building structures, vehicles and imaginative.

29 Claims, 4 Drawing Sheets

BLOCK PUZZLE

BACKGROUND OF THE INVENTION

This invention relates in general to puzzles and deals more particularly with a block puzzle formed by a plurality of interfitting elements and designed to be taken apart and put together.

It is the general aim of the present invention to provide an improved block puzzle of the aforedescribed type to challenge the minds of children and adults of all ages. It is a further aim of the invention to provide an improved block puzzle of durable construction which in taken apart condition comprises a construction toy which includes a plurality of interfitting elements for assembly in various relationships to each other to form fanciful representations of familiar objects, birds, animals, building structures and the like to aide a child in the development of imagination, dexterity and a sense of spacial relationships.

SUMMARY OF THE INVENTION

In accordance with the invention a block puzzle is provided which includes a plurality of interfitting take-apart and put-together pieces, some of which are shaped differently than others. Each of the pieces has the general shape of a letter of the alphabet. The puzzle has at least one assembled condition wherein all of the pieces cooperate in interfitting relation to each other to form a cube.

DETAILED DESCRIPTION OF PREFERRED EMBODIMENT

The block puzzle of the present invention essentially comprises a plurality of interfitting take-apart and put-together puzzle elements or pieces resembling letters of the alphabet and which may be assembled in accordance with a puzzle solution to form a cubic block or cube having six cube faces, at least one face being substantially identical in appearance to another face at the opposite side of the cube. These puzzle elements may also be assembled in a wide variety of other ways to construct fanciful representations of familiar objects, building structures, figures resembling birds, animals, reptiles, as well as imaginative designs, all of which will be hereinafter more fully discussed.

Figure 1:
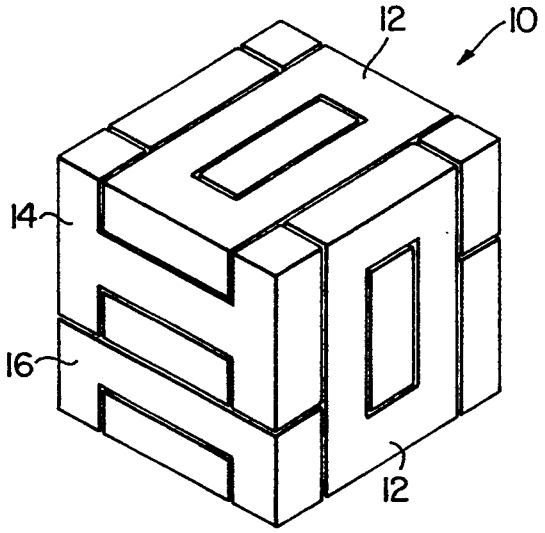
FIG. 1 is a perspective view of an assembled block puzzle embodying the present invention.

Referring now to the drawings and considering first FIGS. 1–7, in FIG. 1 the puzzle elements or pieces which comprise the present invention are shown in an assembled condition forming a block or cube in accordance with the puzzle solution, the block being indicated generally by the reference numeral 10. The individual puzzle pieces or structural elements which comprise the illustrated puzzle block 10 resemble characters or letters of the alphabet and are shown in FIGS. 2–7, respectively, and indicated by the numerals 12, 14, 16, 18, 20 and 22. These puzzle elements may be made from any suitable material and may, for example, be fabricated from wood or molded from a durable plastic material.

Preferably, and as shown in the drawings, the block puzzle 10 is assembled from fourteen puzzle elements which resemble block letters of the English alphabet and include five O-shaped elements 12, 12, three H-shaped elements 14, 14, three C-shaped elements 16, 16 and 18, two U-shaped elements 20, 20 and a single element 22 having the shape of a letter I.

Since the various block letters which comprise the elements of the puzzle 10 are arranged for interfitting assembly an understanding of the dimensional relationships of the various block letters is important to a complete understanding of the invention. The bodies of all of the letters illustrated in FIGS. 2–7 have a common thickness dimension indicated by the letter T in FIGS.

2 and 3 and a common width dimension indicated by the letter W and substantially equal to the letter body thickness dimension T. The remaining dimensions of each letter may be expressed as a ratio of the letter body width W. To further illustrate these dimensional relationships the bodies of the various block letters shown in FIGS. 2–7 are divided into imaginary cubic units of equal size integrally joined in face-to-face relation to each other and indicated by phantom lines.

Figure 2:
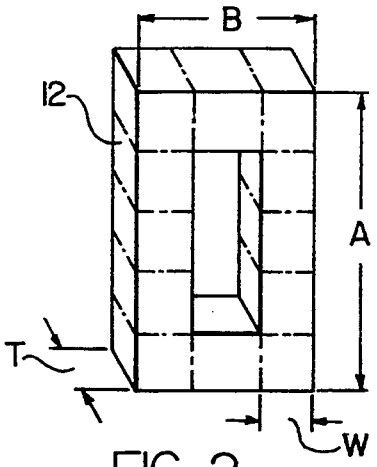
FIG. 2 is a perspective view of an O-shaped element which forms a part of the block puzzle shown in FIG. 1.

Further referring to FIG. 2, the illustrated O-shaped element 12 has a height dimension designated by the letter A and equal to five times the body width dimension W and a breadth dimension B equal to three times the body width W. The element 12 comprises twelve cubic units, substantially as shown in FIG. 2.

Figure 3:
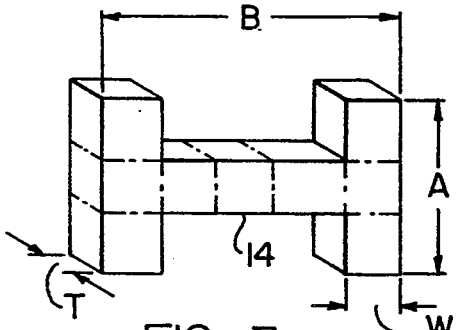
FIG. 3 is a perspective view of another puzzle element resembling a block letter H.

Referring now to FIG. 3, the illustrated letter H has a height dimension A equal to three times the body width dimension W and a breadth dimension B equal to five times the body width W. The illustrated letter H comprises nine cubic units.

Figure 4:
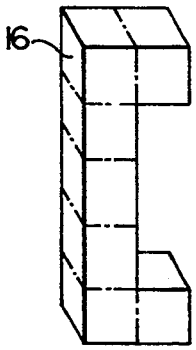
FIG. 4 is a perspective view of a puzzle element resembling a block letter C.

As previously noted, the puzzle block 10 has three C-shaped elements. Two of these C-shaped letters are sized as shown in FIG. 4 and each has a height dimension H equal to five times its body width dimension W and a breadth B equal to twice the width dimension W. The letter C illustrated in FIG. 4 is formed by seven cubic units.

Figure 5:
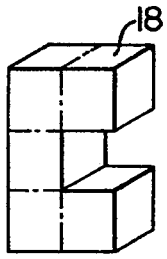
FIG. 5 is a perspective view of another C-shaped puzzle element.

The third C-shaped puzzle element 18, shown in FIG. 5, is somewhat smaller than the C-shaped elements 16, 16 and has a height dimension equal to three times its body width dimension W and a breadth dimension B equal to twice its width dimension W. The C-shaped component B contains five imaginary cubic units.

Figure 6:
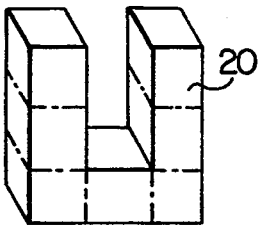
FIG. 6 is a perspective view of a U-shaped puzzle element.

The U-shaped puzzle element shown in FIG. 6, of which there are two, has both a height dimension A and a breadth dimension B equal to three times its body width dimension W and is composed of seven cubic units, substantially as shown.

Figure 7:
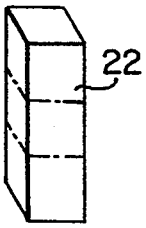
FIG. 7 is a perspective view of a puzzle element resembling a block letter I.

The single letter I embodied in the puzzle cube 10 is shown in FIG. 7 and has a height dimension A equal to three times its body width dimension, a breadth dimension B equal to its body width dimension W and includes three cubic units.

Figure 8:
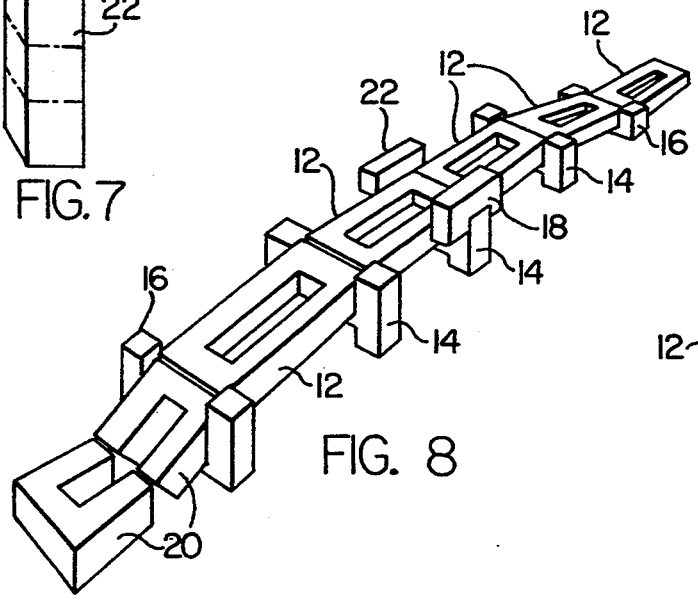
FIG. 8 is a perspective view of a fanciful bridge made from all of the elements which comprise the block puzzle of FIG. 1.
Figure 9:
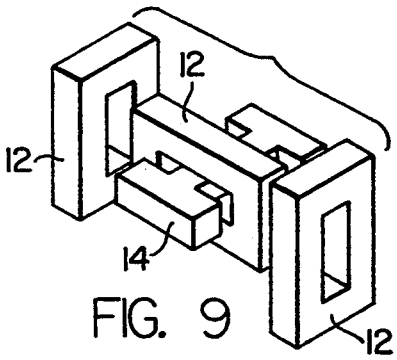
FIG. 9 is a somewhat reduced exploded perspective view illustrating initial steps in the assembly of the puzzle elements to form the cube shown in FIG. 1.
Figure 10:
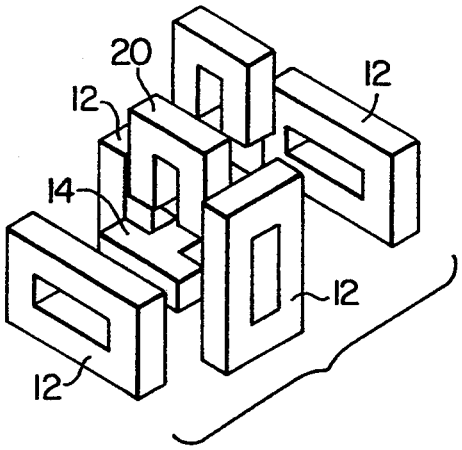
FIG. 10 is an exploded perspective view illustrating further steps in the assembly of the cube in accordance with the puzzle solution.
Figure 11:
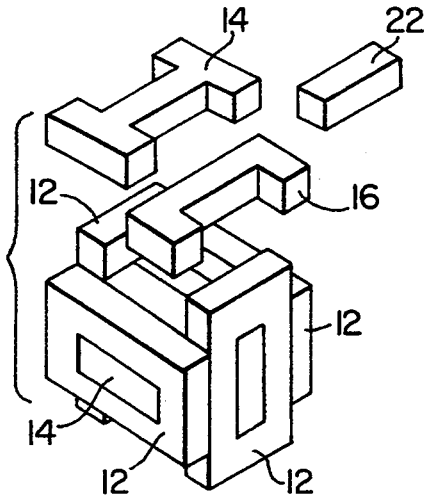
FIG. 11 is an exploded perspective view and illustrates still further steps in a method for assembling the cube of FIG. 1.
Figure 12:
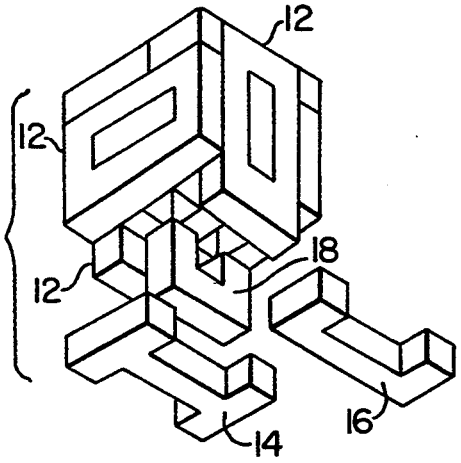
FIG. 12 is a perspective view illustrating final steps for completing the assembly of the cube shown in FIG. 1.

The letter shaped puzzle elements shown in FIGS. 2–7 collectively comprise not only the pieces of the assembled block puzzle or cube shown in FIG. 1 but also serve as the structural elements of a construction toy. These structural elements may be assembled in a wide variety of other ways to make fanciful representations of familiar objects, structures, birds, animal figures, and imaginative designs and in FIG. 8 there is shown a bridge constructed from all of the structural elements which also comprise the puzzle pieces used to assemble the cube 10 shown in FIG. 1.

The exploded perspective views of FIGS. 9–12 illustrate successive steps in the assembly of the puzzle pieces 12–22 to form the block or cube 10 in accordance with the puzzle solution. It will be evident from a close inspection of the exploded views of the cube shown in FIGS. 9–12 that the various puzzle elements may be assembled to form a cube having substantially identical opposite faces. Thus, the top face of the cube is identical in appearance to the bottom face, the front face is identical in appearance to the rear face and the right side face is identical in appearance to the left side face. When the block 10 is assembled from the fourteen puzzle pieces 12–22, two distinct cubic voids of (one) 1 unit dimension are formed within the central portion of the assembled block. However, these voids may be filled by providing two additional cubic filler pieces (not shown) of one (1) unit dimension so that the block 10 comprises a solid cube. If the various puzzle elements are of relatively small size, as, for example, where the puzzle solution results in a four inch cubic block, the aforesaid cubic filler pieces should be omitted, since the provision of such small filler pieces could post a choking hazard to a small child. However, if the puzzle cube is of a larger size so that this hazard is not present, cubic filler pieces may be included to enhance the complexity of the puzzle and such arrangement is contemplated with the scope of the invention.

Figure 13:
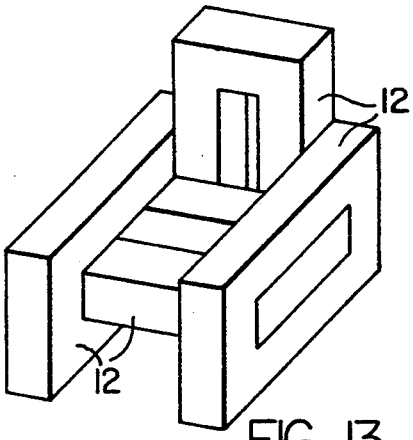
FIG. 13 is a perspective view of a chair made from some of the puzzle elements used to form the cube shown in FIG. 1.
Figure 14:
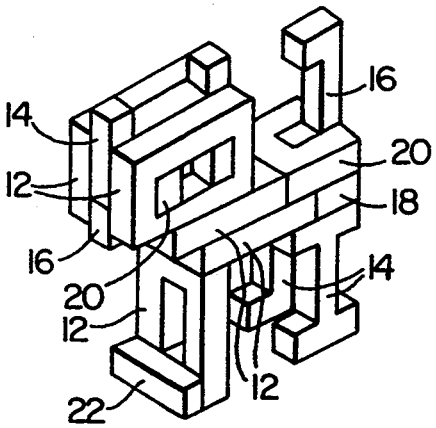
FIG. 14 is a perspective view of a fanciful cat made from all of the puzzle elements used to make the cube shown in FIG. 1.
Figure 16:
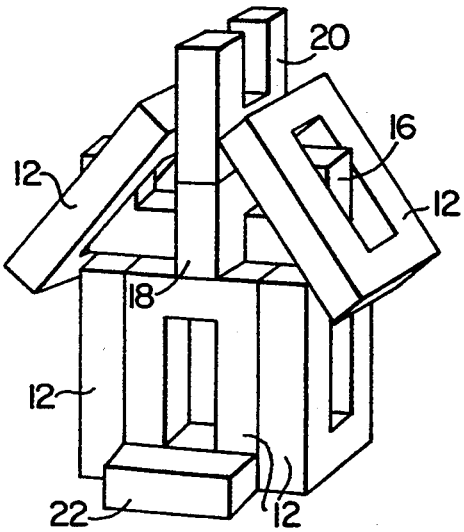
FIG. 16 is a fanciful house made from the puzzle pieces of the present invention.
Figure 15:
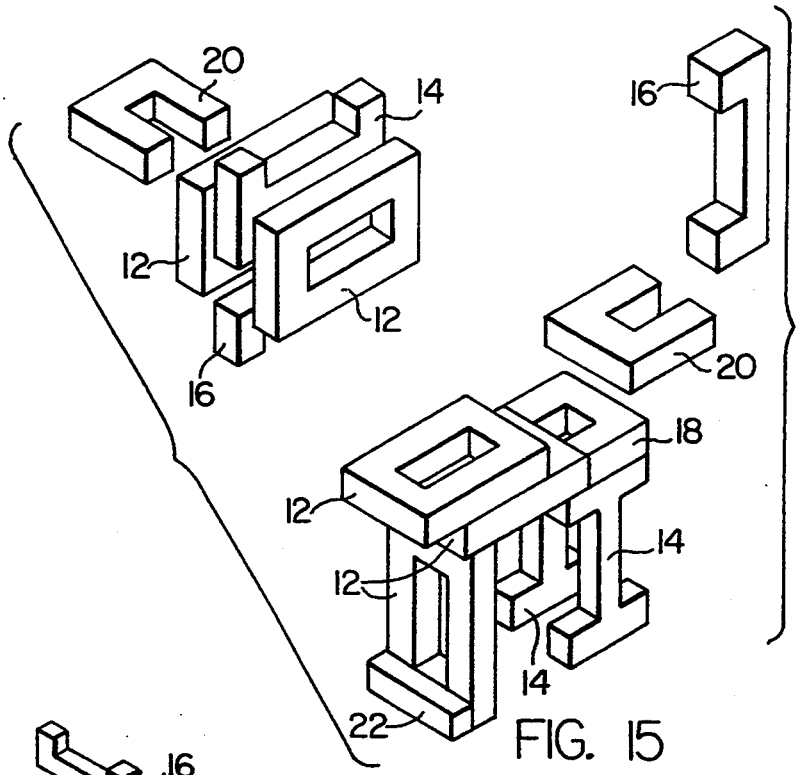
FIG. 15 is an exploded perspective view of the fanciful cat shown in FIG. 14.
Figure 17:
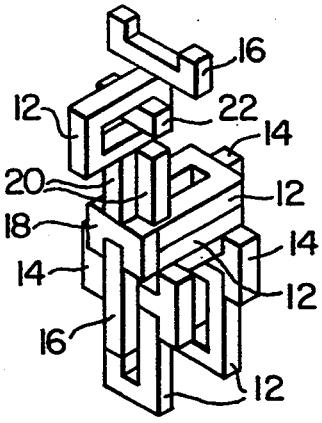
FIG. 17 illustrates a fanciful reindeer construction.
Figure 18:
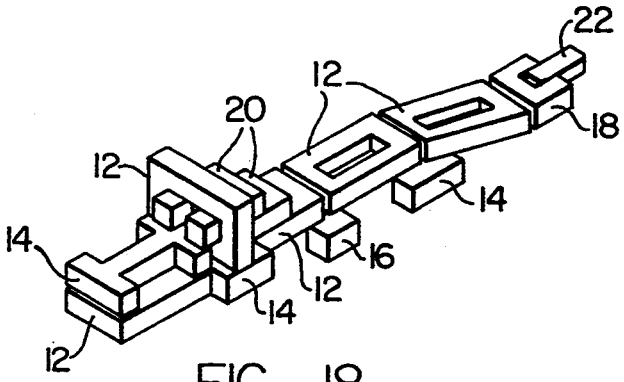
FIG. 18 shows a fanciful alligator made with elements which comprise the block puzzle of the present invention.
Figure 20:
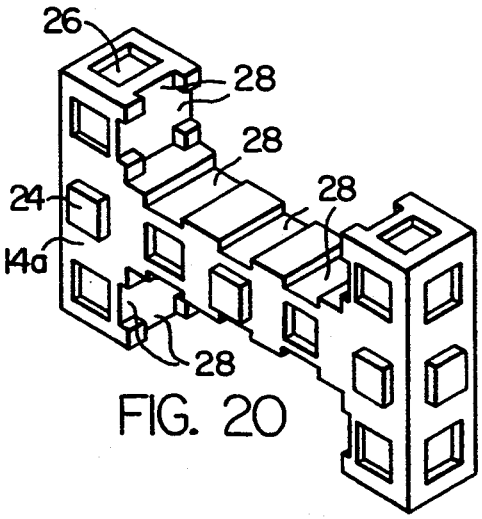
FIG. 20 is a perspective view of a puzzle or construction element resembling the letter H and made in accordance with said further embodiment of the invention.
Figure 22:
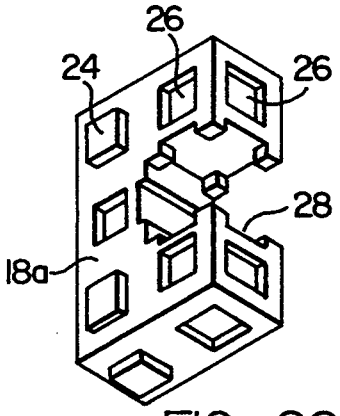
FIG. 22 is a perspective view of another C-shaped puzzle element in accordance with said further embodiment.
Figure 19:
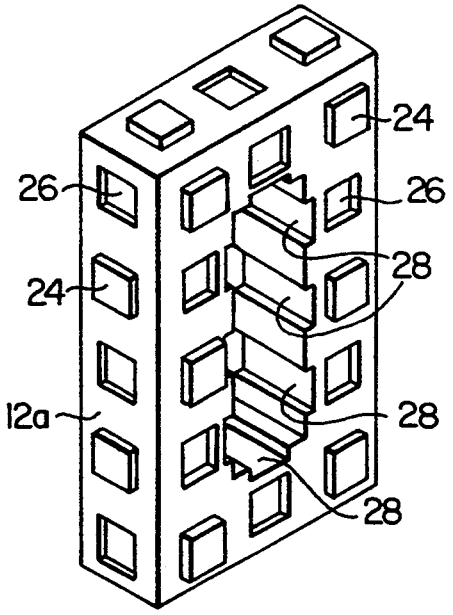
FIG. 19 is a perspective view of an O-shaped puzzle element in accordance with a further embodiment of the invention.
Figure 21:
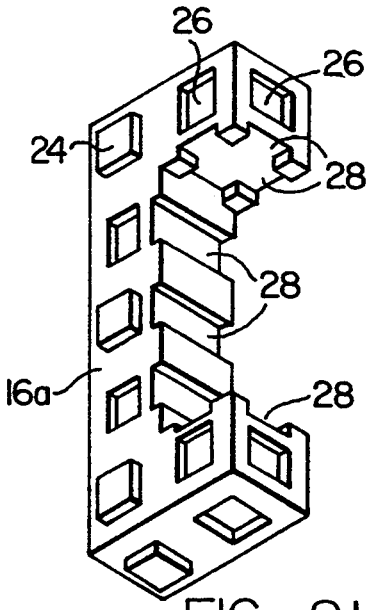
FIG. 21 is a perspective view of a C-shaped puzzle element in accordance with said further embodiment.

When used as a construction toy, the various puzzle pieces shown in FIGS. 2–7 and hereinbefore described are capable of assembly in a multitude of different ways to provide amusement to children of all ages and adults as well, as will be evident from consideration of FIGS. 13–18 of the drawings which exemplify such assemblies. The construction of a simple familiar object or static structure, such as the chair shown in FIG. 13, is within the capability of a young child. The house construction shown in FIG. 16 requires a somewhat higher level of skill and experience. An older child or adult will derive enjoyment from building a more challenging structure, such as the cat figure, shown in FIG. 14 and FIG. 15 illustrates the manner in which the cat of FIG. 14 is assembled using all of the structural elements which comprise the block 10 shown in FIG. 1. In FIG. 17 there is shown a fanciful reindeer constructed from puzzle pieces. FIG. 18 illustrates an alligator made with puzzle components. The cubic form of the puzzle 10 shown in FIG. 1 is ideal for packaging and for storage after the toy has been used.

Figure 23:
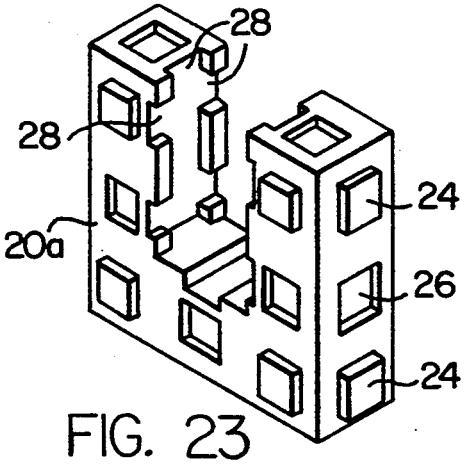
FIG. 23 is a perspective view of a U-shaped structural puzzle element in accordance with said further embodiment of the invention.
Figure 24:
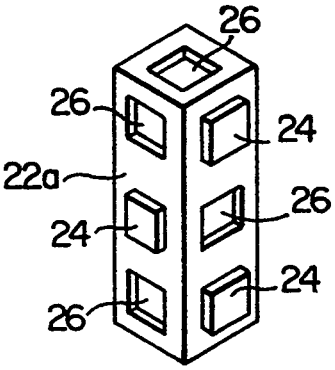
FIG. 24 is a perspective view of an I-shaped puzzle element in accordance with said further embodiment.

Further considering the drawings, FIGS. 19–24 illustrate another group of puzzle pieces which collectively comprise a further embodiment of the invention. These puzzle pieces are similar in most respects to the previously described puzzle elements 12–22 and bear the same reference numerals as the previously described corresponding elements but include a letter "a" suffix. Thus, for example, the puzzle piece 12*a* shown in FIG. 19 generally corresponds to the previously described puzzle piece 12 illustrated in FIG. 2. Specifically, the further embodiment illustrated in FIGS. 19–24 comprises fourteen puzzle pieces which include five generally O-shaped pieces 12*a*, 12*a*, three H-shaped pieces 14*a*, 14*a* two pieces 16*a*, 16*a* shaped like a letter C and another C-shaped puzzle piece designated by the numeral 18a, but somewhat smaller than the C-shaped piece 16*a* shown in FIG. 21. This further embodiment of the invention also includes two generally U-shaped puzzle components 20*a*, 20*a*, such as shown in FIG. 23, and a single I-shaped puzzle element 22*a* illustrated in FIG. 24.

As in the previously described embodiment the fourteen puzzle pieces 12*a*–22*a* may be assembled in accordance with a puzzle solution to form a substantially cubic block generally similar to the previously described cubic block 10 shown in FIG. 1. The puzzle components 12*a*–22*a* dimensionally related to each other as previously described and are also adapted for use as a construction toy and may be assembled in a multiplicity of ways, as previously described.

Like the previously described puzzle pieces 12–22 the pieces 12*a*–22*a* may be taken apart or put together in interfitting relation and are readily separable from each other. However, the puzzle pieces 12*a*–22*a* differ from those previously described in that each has a plurality of bosses 24, 24 which project from surfaces thereof and a plurality of discrete recesses 26, 26 formed therein for receiving and complementing bosses 24, 24 on one or more associated puzzle pieces when the pieces are brought together with associated surfaces in face-to-face relation to each other. With the exception of the I-shaped element shown in FIG. 24 each of the puzzle pieces have slots 28, 28 formed therein, substantially as shown. These slots permit passage of bosses 24, 24 therethrough to facilitate assembly. Thus, for example, the I-shaped puzzle piece 22*a* which has a recess 26 in it upper end and a boss 24 on its lower end (not shown) may be moved laterally into the central opening in the O-shaped element 12*a* for assembly therein. The slots 28, 28 in the O-shaped element accommodate the projecting bosses 24, 24 on the I-shaped element.

When the various puzzle pieces 12*a*–22*a* are assembled in face-to-face relation to each other the bosses 24, 24 cooperate with associated recesses 26, 26 to restrain each one of the assembled elements against movement in at least one direction relative to another associated element. Thus, while the assembled puzzle components may be readily separated from each other the bosses and recesses cooperate to impart stability to the assembly.

I claim:

1. A puzzle comprising interfitting take-apart and put-together elements shaped like a plurality of different letters of the alphabet, some of said letters being of different size than other of said letters, said elements in at least one assembled condition cooperating in interfitting relation to each other forming a cube having six cube faces, each of said cube faces being substantially identical in appearance to another of said cube faces at the opposite side of said cube.

2. A puzzle as set forth in claim 1 wherein said letters are further characterized as block letters and each of said letters has a body defined by a plurality of cubic units of equal size integrally joined in face-to-face relation to each other.

3. A puzzle as set forth in claim 2 wherein said elements include a plurality of O-shaped elements.

4. A puzzle and construction toy as set forth in claim 3 wherein each of said O-shaped elements has a height dimension equal to five times the width dimension of said body and a breadth dimension equal to three times the width dimension of said body.

5. A puzzle as set forth in claim 2 wherein said elements include a plurality of H-shaped elements.

6. A puzzle as set forth in claim 5 wherein each of said H-shaped letters has a height dimension equal to three times the width dimension of said body and a breadth dimension equal to five times the width dimension of said body.

7. A puzzle as set forth in claim 2 wherein said elements include a plurality of C-shaped elements.

8. A puzzle as set forth in claim 7 wherein two said C-shaped elements have a height dimension equal to five times the width dimension of said body and a breadth dimension equal to twice the width dimension of said body.

9. A puzzle as set forth in claim 7 wherein one of said C-shaped letters has a height dimension equal to three times the width dimension of said body and a breadth dimension equal to twice the width dimension of said body.

10. A puzzle as set forth in claim 2 wherein said elements include a plurality of U-shaped elements.

11. A puzzle as set forth in claim 10 wherein each of said U-shaped letters has a height dimension equal to three times said width dimension of said body and a breadth dimension equal to three times the width dimension of said body.

12. A puzzle as set forth in claim 2 wherein said elements include an I-shaped element.

13. A puzzle as set forth in claim 12 wherein said I-shaped letter has a height dimension equal to three times the width dimension of said body and a breadth dimension equal to he width dimension of said body.

14. A puzzle as set forth in claim 1 wherein said elements consist of fourteen elements.

15. A puzzle as set forth in claim 1 including retaining means for releasably securing each one of said elements against movement in at least one direction relative to another of said elements when said one element is disposed in an assembled condition relative to said another element.

16. A puzzle as set forth in claim 15 wherein said retaining means comprises a boss on said one element and a recess in said another element receiving said boss therein.

17. A puzzle as set forth in claim 15 wherein said elements consist of fourteen elements.

18. A puzzle as set forth in claim 1 wherein said puzzle further comprises a construction toy and said elements cooperate in interfitting relation to each other in a multiplicity of other assembled conditions to form fanciful representations of birds, animals, reptiles and static structures.

19. A puzzle and construction toy as set forth in claim 18 wherein some of said elements are formed from a different number of cubic units than other of said elements.

20. A puzzle and construction toy comprising a plurality of interfitting take-apart and put-together elements shaped like letters of the alphabet and including five O-shaped elements, three H-shaped elements, three C-shaped elements, two U-shaped elements, and one I-shaped element, said elements in at least one assembled condition cooperating in interfitting relation to each other forming a cube.

21. A puzzle and construction toy as set forth in claim 20 wherein said elements consist of fourteen elements.

22. A puzzle and construction toy as set forth in claim 20 wherein said elements cooperate in interfitting relation to each other in a multiplicity of other assembled conditions to form fanciful representations of birds, animals and structures.

23. A puzzle and construction toy consisting of fourteen take-apart and put-together elements shaped like block letters of the English alphabet, each of said letters having a letter body, the width of said letter body being equal to the thickness of said letter body, said elements including five O-shaped letters, each of said O-shaped letters having a height dimension equal to five times the width dimension of said letter body and a breadth dimension equal to three times the width dimension of said letter body, said elements including three H-shaped letters, each of said H-shaped letters having a height dimension equal to three times the width dimension of said letter body and a breadth dimension equal to five times the width dimension of said letter body, said elements including three C-shaped letters, two of said C-shaped letters having a height dimension equal to five times the width dimension of said letter body and a breadth dimension equal to twice the width dimension of said letter body, one of said C-shaped letters having both a height dimension and a breadth dimension equal to twice the width dimension of said letter body, said elements including two U-shaped letters, each of said U-shaped letters having both a height dimension and a breadth dimension equal to three times the width dimension of said letter body, said elements including a single I-shaped letter having a height dimension equal to three times the width dimension of said letter body and a breadth dimension equal to the width dimension of said letter body, said elements in at least one assembled condition cooperating in interfitting engagement with each other forming a cube.

24. A puzzle comprising interfitting take-apart and put together elements shaped like a plurality of different block letters of the alphabet, some of said letters being different than other of said letters, each of said letters having a body, the width dimension of said body being substantially equal to the thickness dimension of said body, said letters including five O-shaped letters, said elements in at least one assembled condition cooperating in interfitting relation to each other to form a cube.

25. A puzzle comprising interfitting take-apart and put together elements shaped like a plurality of different block letters of the alphabet, some of said letters being different than other of said letters, each of said letters having a body, the width dimension of said body being substantially equal to the thickness dimension of said body, said letters including three H-shaped letters, said elements in at least one assembled condition cooperating in interfitting relation to each other to form a cube.

26. A puzzle comprising interfitting take-apart and put together elements shaped like a plurality of different block letters of the alphabet, some of said letters being different than other of said letters each of said letters having a body, the width dimension of said body being substantially equal to the thickness dimension of said body, said letters including three C-shaped letters, said elements in at least one assembled condition cooperating in interfitting relation to each other to form a cube.

27. A puzzle comprising interfitting take-apart and put together elements shaped like a plurality of different block letters of the alphabet, some of said letters being different than other of said letters, each of said letters having a body, the width dimension of said body being substantially equal to the thickness dimension of said body, said letters including two U-shaped letters, said elements in at least one assembled condition cooperating in interfitting relation to each other to form a cube.

28. A puzzle and construction toy comprising a plurality of take-apart and put-together elements shaped like block letters of the alphabet, each of said elements defined by a plurality of cubic units of equal size integrally joined together in face-to-face relation to each other, said elements cooperating with each other in at least one assembled condition to form a cube having six cube faces, at least one of said cube faces being substantially identical in appearance to another of said cube faces, said elements cooperating with each other in a multiplicity of other assembled conditions to form fanciful representations of birds, animals, reptiles and static structures.

29. A puzzle and construction toy as set forth in claim 28 wherein some of said elements are formed from a different number of cubic units than other of said elements.

* * * * *